US006025812A

United States Patent [19]

Gabriel et al.

[11] Patent Number: 6,025,812

[45] Date of Patent: Feb. 15, 2000

[54] ANTENNA ARRAY

[75] Inventors: Roland Gabriel; Max Gottl, both of Grosskarolinenfeld; Georg Klinger, Saaldorf-Surheim, all of Germany

[73] Assignee: Kathrein-Werke KG, Rosenheim, Germany

[21] Appl. No.: 09/029,198

[22] PCT Filed: Jun. 5, 1997

[86] PCT No.: PCT/EP97/02922

§ 371 Date: Feb. 25, 1998

§ 102(e) Date: Feb. 25, 1998

[87] PCT Pub. No.: WO98/01923

PCT Pub. Date: Jan. 15, 1998

[30] Foreign Application Priority Data

Jul. 4, 1996 [DE] Germany ..... 196 27 015

[51] Int. Cl.[7] ..... H01Q 21/26

[52] U.S. Cl. ..... 343/797; 343/767; 343/770; 343/813

[58] Field of Search ..... 343/793, 797, 343/798, 767, 770, 800, 810, 812, 813, 815, 817, 818, 819, 834, 795; H01Q 21/26

[56] References Cited

U.S. PATENT DOCUMENTS 3,510,876 5/1970 Green et al. ..... 343/798
3,541,559 11/1970 Evans ..... 343/798

FOREIGN PATENT DOCUMENTS 0 559 980 9/1993 European Pat. Off. .
0 685 900 12/1995 European Pat. Off. .
0 717 460 6/1996 European Pat. Off. .
71 42 601 7/1972 Germany .
43 02 905 3/1994 Germany .

OTHER PUBLICATIONS

Heilman, A.: Antennen, Zweiter Teil Bibliographisches Institut Manheim/WienZ&Zürich, 1970, pp. 47–50.
Rostan, F. et al.: Dual Polarisierte Microstrip–Patch–Antennenarrays für Satellitengestützte Aktive SAR–Systeme. In: ITG–Fachbericht 128, Antennan, VDE–Verlag–GmbH, Berlin, Offenbach, 1994, pp.259–264.
Zehetner, H.: Neue Sendeantenne für terrestrisches Fersehen bei 2,6 GHz. In: ITG–Fachbericht 128, Antennen, VDE–Verlag–GmbH, Berlin, Offenbach, 1994, pp. 356–362.

*Primary Examiner*—Don Wong
*Assistant Examiner*—Hoang Nguyen
*Attorney, Agent, or Firm*—Nixon & Vanderhye

[57] ABSTRACT

An antenna array for simultaneous reception or for simultaneous transmission of electromagnetic waves having two linear, orthogonal polarizations has a decoupling device (17) between adjacent radiating element modules (1). This decoupling device is provided between two radiating element modules (1) which are adjacent in the attachment direction (21). The improvement is for a decoupling structural element (17) to be provided between two adjacent radiating element modules (1), which decoupling structural element (17) extends at least with its longitudinal component in the attachment direction (21), this longitudinal component having a length which is greater than or equal to 25% of the radiating element module separation (25) between the centers or bases (23) of the corresponding adjacent radiating element modules (1).

19 Claims, 6 Drawing Sheets

ANTENNA ARRAY

Figure 1A:
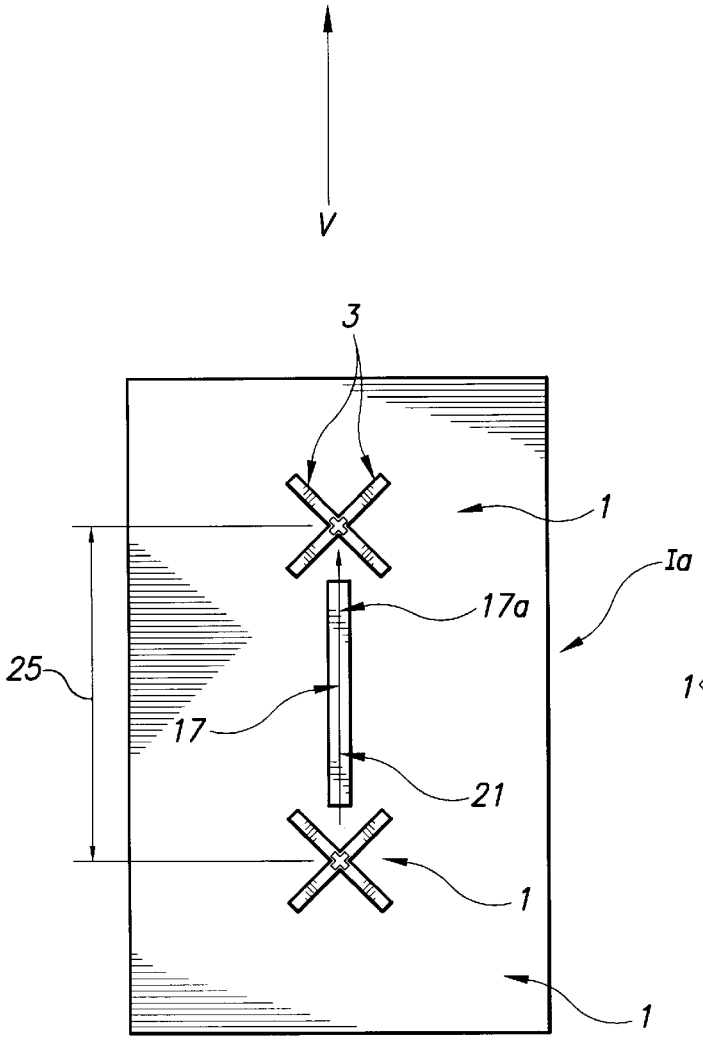

The invention relates to an antenna array for simultaneous reception or for simultaneous transmission of electromagnetic waves having two linear, orthogonal polarizations, according to the preamble of claim 1.

Dual-polarized antenna arrays, that is to say radiating element arrangements which [lacuna] dipoles, slot or planar radiating elements for simultaneous reception or simultaneous transmission of electromagnetic waves having two orthogonal, linear polarizations, which are supplied to separate and mutually decoupled outputs, have been known for a long time. In this case, such radiating element arrangements comprise, for example, a plurality of elements in the form of dipoles, slots or planar radiating elements, as are known, for example, from EP 0 685 900 A1 or from the prior publication "Antennen" [Antennas], 2nd part, Bibliographic Institute, Mannheim/Vienna/Zurich, 1970, pages 47 to 50. From this, for example in the case of omnidirectional radiating elements with horizontal polarization, the shapes of a dipole square or of a dipole cross are known, in which coupling exists between the two systems, which are spatially offset through 90°.

In order to increase the directionality, such radiating element arrangements, which are also referred to as radiating element modules in the following text, are normally arranged in front of a reflective surface, the so-called reflector, and, in the case of planar antennas, a metallic layer on the substrate can at the same time act as the reflector.

In order to increase the antenna gain, it is possible to interconnect a plurality of these radiating element modules to form antenna arrays. In this case, it is, in fact, quite normal to interconnect ten or more radiating element modules per transmitting and receiving station to form an array. The radiating element modules can in this case be arranged alongside one another or one above the other. The direction in which the radiating element modules are arranged in a straight line or inclined alongside one another or one above the other is in this case called the alignment of the antenna array.

However, it has been found to be disadvantageous that, when a plurality of radiating element modules are interconnected, the resulting decoupling of the arrays between the interconnected radiating element modules of both polarizations turns out to be considerable poorer than that of the radiating element module itself. These disadvantageous effects occur primarily when the alignment of the antenna array does not coincide with one of the two polarization planes. This situation arises mainly in the case of antenna arrays which are constructed such that the radiating element modules are arranged one above the other in the vertical direction, the radiating element modules being aligned such that they receive or transmit linear polarizations at an angle of +45° and −45° with respect to the vertical. Such antenna arrays, whose alignment differs from the polarization plane, are also referred to in the following text, for short, as X-polarized arrays.

In the case of such arrays, it is found that, inter alia, the lack of correspondence between the alignment of the array and the polarization planes as well as the oblique position of the polarization planes with respect to the reflector results in adjacent modules being relatively strongly coupled to one another. In this case, it is not rare for decoupling levels of, for example, 20 to 25 dB to occur, which has been found to be inadequate.

Since vertical polarization is used by preference in the mobile radio field, this antenna type has the advantage over dual-polarized antennas having horizontal and vertical polarization that it is possible to transmit to the mobile station using both polarizations.

Antenna arrays have already been proposed which, in order to improve the decoupling, provide separating walls between the individual radiating elements, that is to say the radiating element modules, which separating walls are thus aligned at right angles to the attachment or connection direction or line between two adjacent radiating element modules. Trials have now shown that such a design generally even leads to deterioration in the decoupling, particularly in the case of broadband antennas, in the case of X-polarized arrays, due to the polarization rotation which is to be found.

Finally, it is also known in the case of individual radiating elements which are arranged vertically one above the other, and use horizontal polarization, that rods arranged horizontally result in an improvement in the decoupling between the individual radiating elements. However, this improvement in the decoupling relates only to radiating elements with the same polarization and, in the case of X-polarized arrays (in which, for example, the vertical alignment of the arrays, as mentioned, does not coincide with the linear polarizations of, for example, +45° and −45°, generally does not lead to any improvement in the decoupling between the different polarized feed systems.

An antenna array which corresponds to the antennas explained above has also already been disclosed, for example, in U.S. Pat. No. 3,541,559. The antenna array comprises a plurality of radiating element modules which are arranged in an antenna matrix, that is to say they are arranged in a plurality of horizontal rows and vertical columns, a reflector element which is in the form of a rod and acts like a parasitic reflector in each case being arranged between two radiating element modules that are arranged vertically or horizontally adjacent to one another. This parasitic reflector element in the form of a rod is in each case aligned transversely with respect to the connecting line which connects two adjacent radiating element modules. These parasitic reflector elements are used for beam forming, which is still effective even when a single radiating element module is used.

The object of the present invention is thus to provide an X-polarized antenna array which preferably has a high level of decoupling, over a broad band width, between the resulting feed systems for both polarizations.

The object is achieved according to the invention by the features specified in claim 1. Advantageous refinements of the invention are specified in the dependent claims.

It may be considered highly surprising that the solution according to the invention makes it possible to achieve a considerable improvement in the desired decoupling of the respective adjacent radiating element modules in comparison with the prior art. While in the case of comparable dual-polarized antenna arrays (that is to say in the case of antenna arrays in which two electromagnetic waves of different polarity are used for transmission simultaneously), which do not have adequate decoupling, it was necessary, for example for a given antenna gain, to arrange at least two spatially offset antenna arrays separately for transmission and reception per base station antenna, comparable results can now be achieved according to the invention by only one X-polarized antenna array since, in this case, the antenna array can be used both for transmission and for reception as a result of the high level of decoupling of more than, for example, 30 dB. This leads to a considerable cost advantage, of course.

Thus, owing to the high level of decoupling that can be achieved between the polarizations in antenna arrays with a high level of vertical beamforming, the solution according to the invention is particularly suitable for the mobile radio field.

According to the invention, these advantages are achieved by providing a decoupling device, having a novel structural element, between two adjacent radiating element modules. In a completely contrary manner to the horizontal separating walls or rods used, for example, in vertically aligned antenna arrays, this structural element is arranged in exactly the opposite manner. Specifically, the structural element which is used according to the invention for decoupling has a longitudinal extent which is aligned in the vertical attachment direction of two arrays arranged alongside one another (in principle, also for the horizontal attachment direction of two arrays arranged alongside one another). In other words, good results are achieved even with a vertically aligned X-polarized array if a longitudinal rod extending in the vertical direction is fitted between two radiating element modules arranged one above the other or, if required, a longitudinal slot (which is provided in the reflector surface or in a further conductive surface in front of this surface) or another structural element is fitted having a longitudinal recess or extent.

Particularly advantageous results are, however, achieved if a decoupling device having a cruciform structural element is used between two adjacent X-polarized radiation element modules, which structural element comprise [sic], for example, two mutually crossing individual rods (that is to say metallic conductive rods) or cruciform slots which are incorporated in the reflector surface or a metallic conductive surface located offset but parallel to it.

In a preferred embodiment, the conductive, cruciform structural elements are in this case conductively connected to one another at their intersection.

Finally, it has been found to be advantageous if the cruciform, conductive structural elements are located in different planes from one another, provided these planes are not substantially more than half a wavelength away from one another.

Figure 1B:
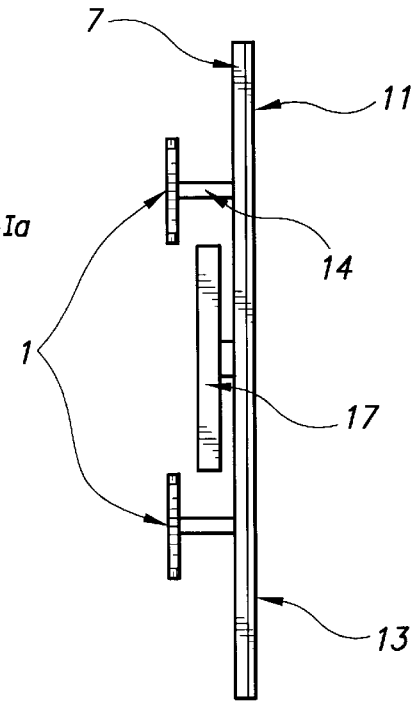

The invention is explained in more detail in the following text with reference to exemplary embodiments. In this case, in detail:

FIG. 1*a*: shows a schematic plan view of an antenna array having two radiating element modules and a decoupling device according to the invention provided inbetween, in plan view [sic];

FIG. 1*b*: shows a side view along the arrow direction Ib in FIG. 1*a;*

Figure 2A:
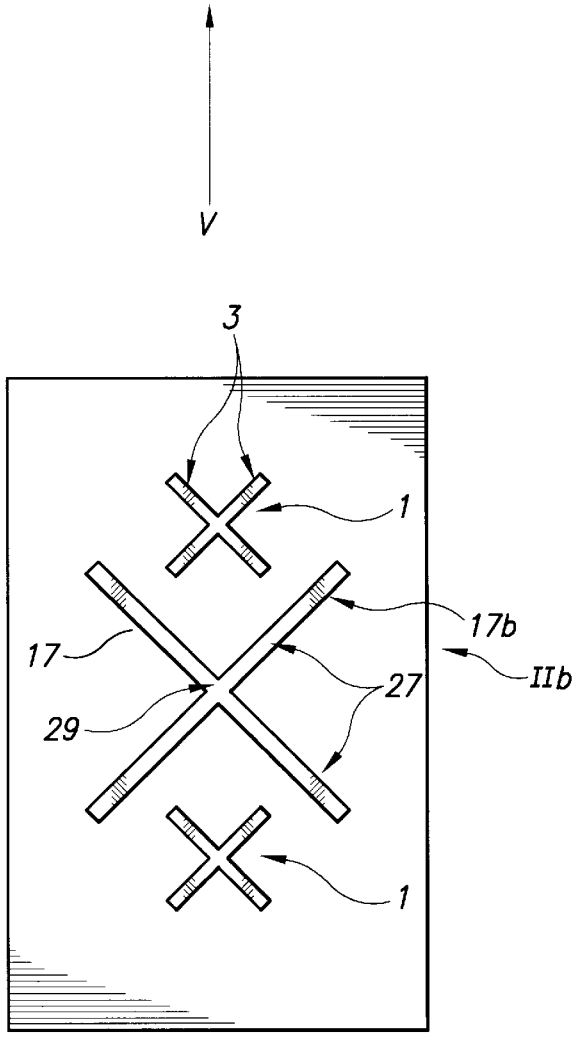
Figure 2B:
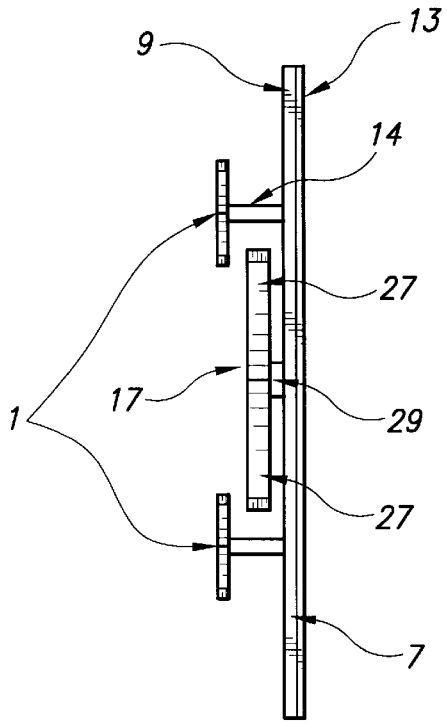

FIG. 2*a*: shows a plan view of a modified exemplary embodiment of an antenna array according to the invention having a cruciform decoupling device;

FIG. 2*b*: shows a side elevation in the arrow direction IIb in FIG. 2*a;*

Figure 2C:
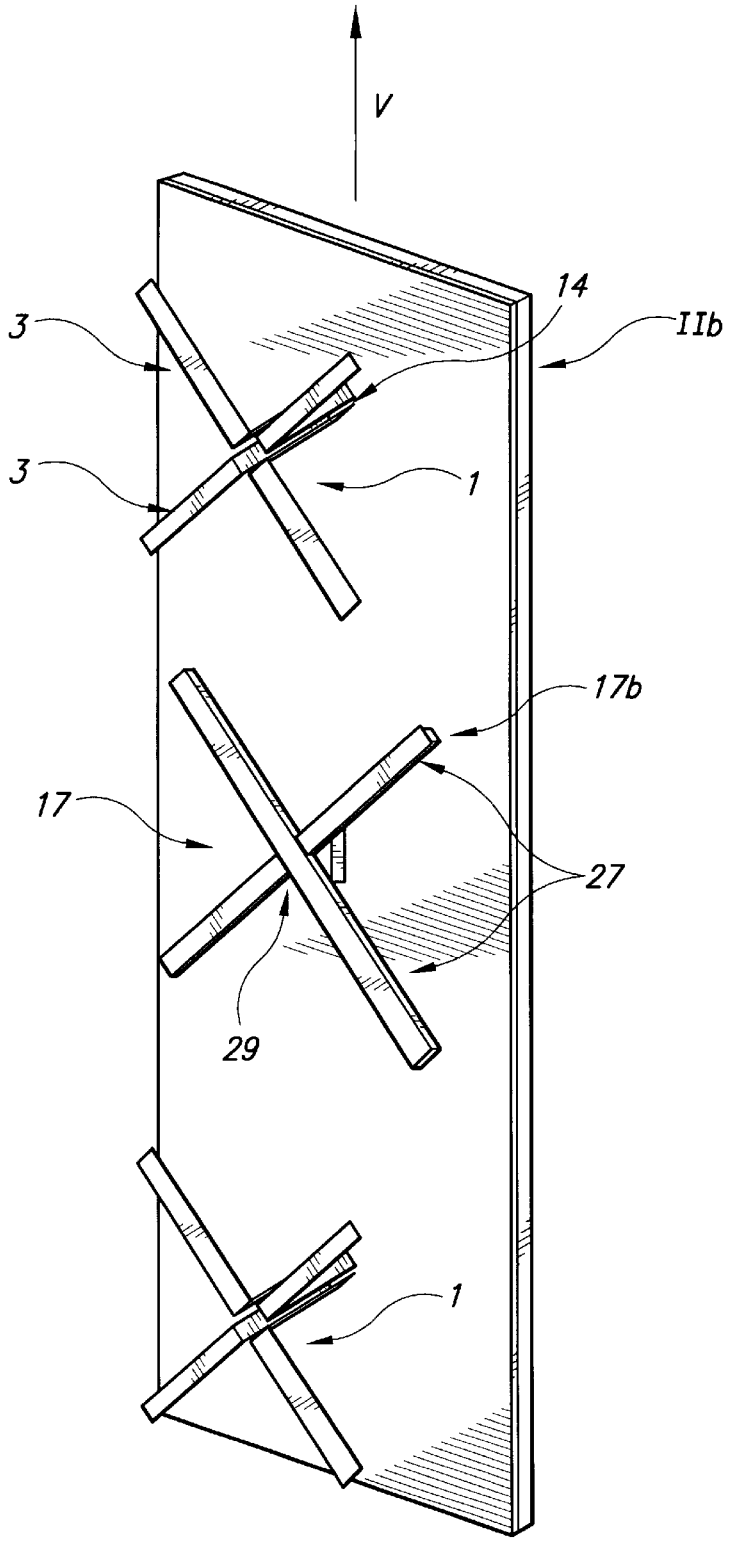

FIG. 2*c*: shows a schematic perspective [sic] illustration of the exemplary embodiment according to FIG. 2*a* and FIG. 2*b;*

Figure 3A:
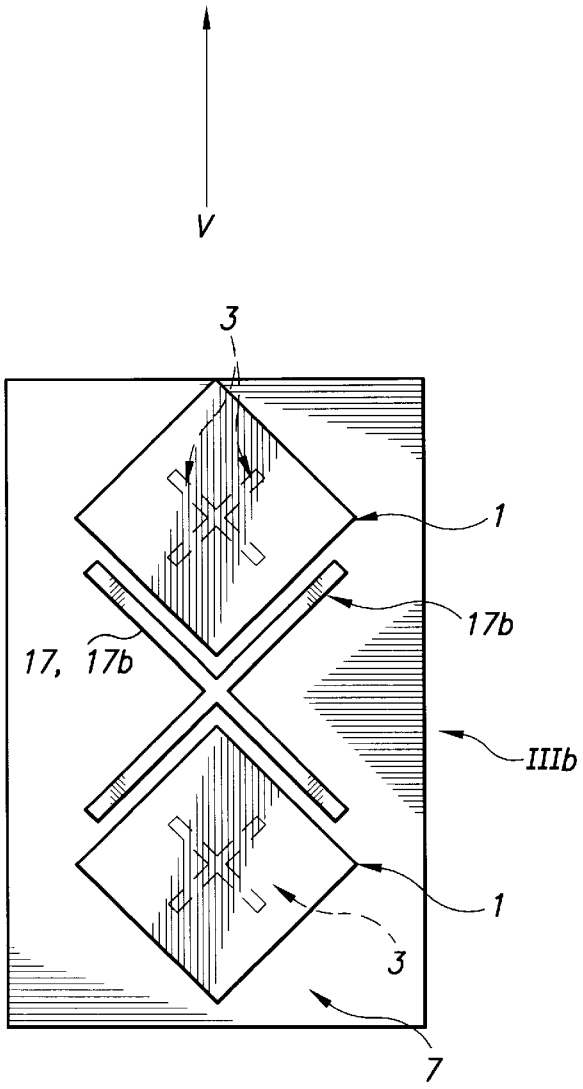
Figure 3B:
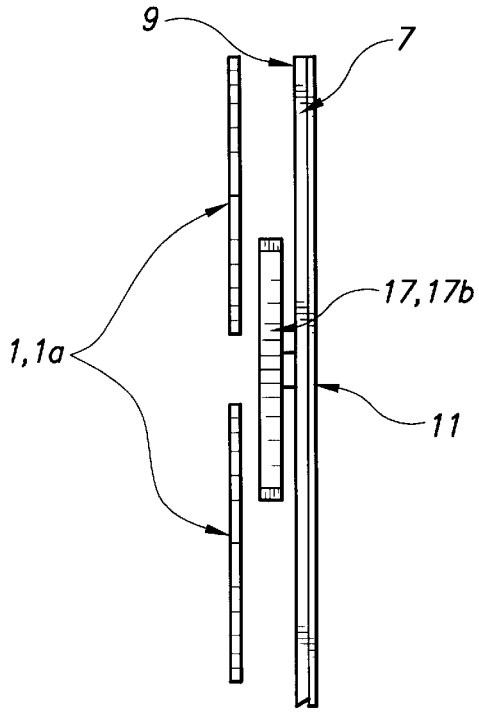

FIG. 3*a*: shows an exemplary embodiment which is modified from that in FIG. 2*a* and in which so-called patch radiating elements are used as the radiating element modules;

FIG. 3*b*: shows a side elevation of FIG. 3*a* in the arrow direction IIIb in FIG. 3*a;*

Figure 4A:
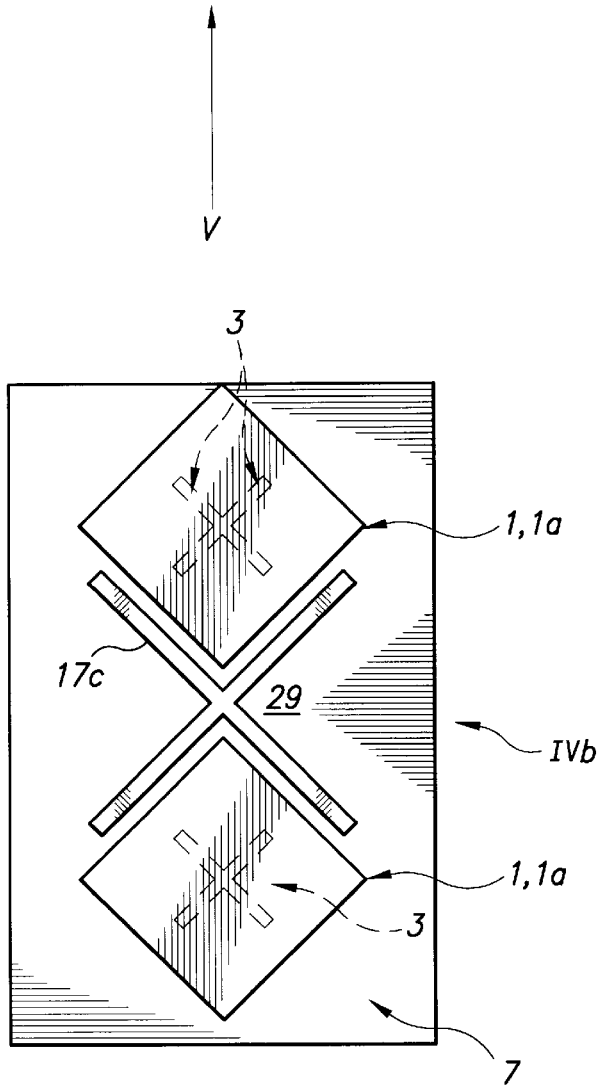
Figure 4B:
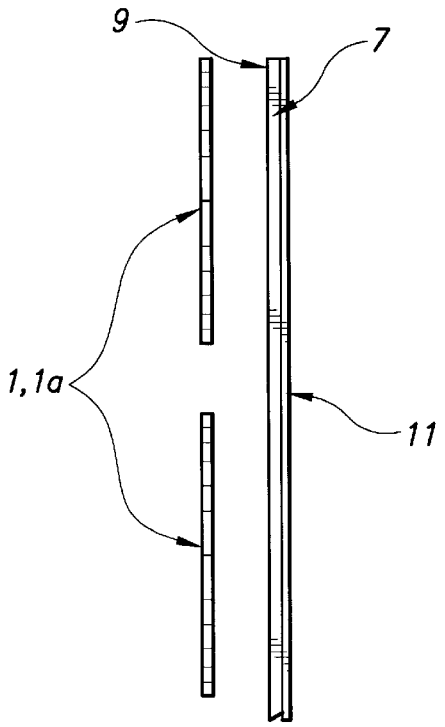

FIG. 4*a*: shows a plan view of a further exemplary embodiment of an antenna array;

FIG. 4*b*: shows a corresponding side elevation in the arrow direction IVb in FIG. 4*a*.

Figure 5:
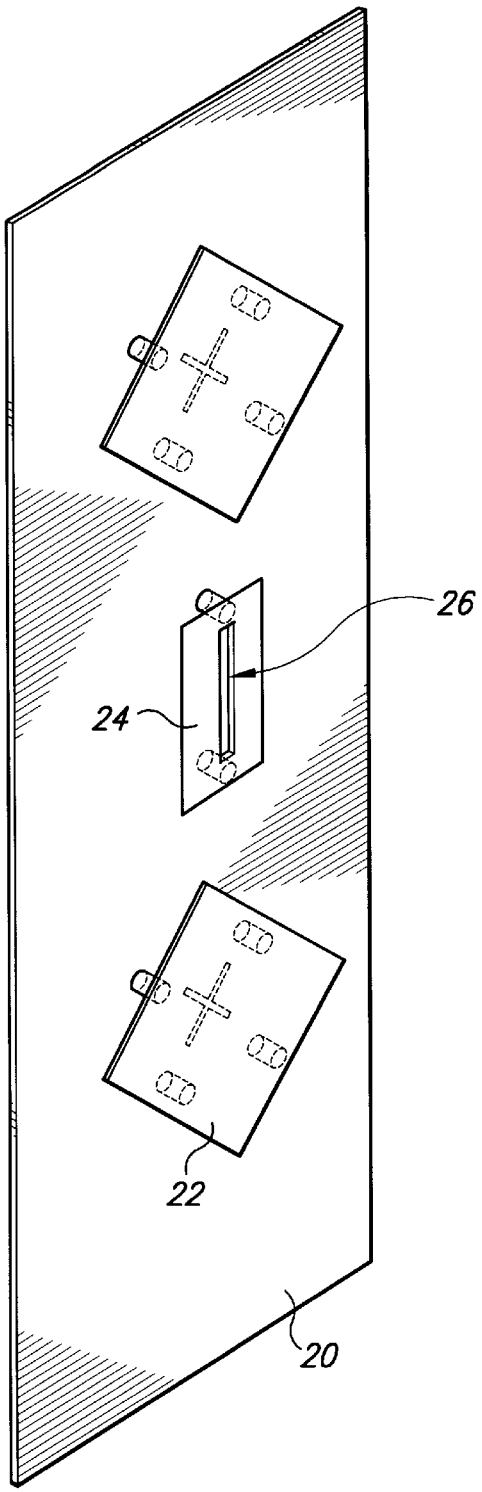

FIG. 5 is a perspective view of a reflector with patch radiating elements and a slotted decoupling element spaced in front of the reflector.

The following text first of all describes the exemplary embodiment according to FIGS. 1*a* and 1*b*. In this exemplary embodiment, an antenna array is illustrated having two radiating element modules 1, which comprise a Doppel-dipole arrangement 3. This may be, for example, a so-called turnstile antenna which comprises two systems that are aligned spatially offset through 90° and are fed separately. Alternatively, in contrast to those, other double-dipole arrangements may be used in which, in plan view, that is to say in the preferred transmission direction, the individual dipoles have, for example, a square structure (that is to say a so-called dipole square). Finally, other different radiating element modules can also be used to receive electromagnetic waves having two linear, orthogonal polarizations, as will be explained in the following text, with reference to so-called patch radiating elements.

The radiating element modules 1 are mounted in front of a reflector 7 with their dipoles at a distance from the reflector 7 and being seated on it. In the illustrated exemplary embodiment, the reflector 7 is formed by metallization 9 on a panel 11, on the rear of which a feed network 13 is located which interconnects the individual radiating element modules separately for the respective polarization. The dipoles 3 are in this case held mechanically with respect to the panel 11 and are made contact with electrically via a so-called balancing device 14, that is to say they are thus fed from the panel 13.

In the illustrated exemplary embodiment, the two illustrated radiating element modules 1 are arranged one above the other in a vertical alignment V and, in the process, are in turn arranged aligned parallel to the reflector plane. The double-dipole arrangement 3 is thus chosen such that the radiating element modules 1 allow a linear polarization of +45° and −45°, with respect to the vertical V, to be received.

In order to achieve a high level of decoupling between the two radiating element modules 1 a decoupling structural element 17 is furthermore provided in the exemplary embodiment explained according to FIGS. 1*a* and 1*b*, which decoupling structural element 17 comprises a conductive rod 17*a*. In the illustrated exemplary embodiment, this is arranged centrally between the two radiating element modules 1, the rod 17*a* being located between the adjacent radiating element modules 1 in the connection direction or attachment direction 21 of the radiating element modules 1, that is to say on the direct connecting line between the adjacent radiating element modules 1.

The longitudinal or extent component of the decoupling structural element 17 according to the exemplary embodiment in FIGS. 1*a* and 1*b* is greater than or equal to at least ¼ of the distance between the two adjacent centers or bases 23 of the radiating element modules. The longitudinal component is in this case preferably more than 40 or 50% of the said radiating element module separation 25.

The illustrated rod 17*a* is arranged at a short distance above the reflector surface 7 and, in the process, is held on the reflector 7, that is to say mechanically, by the panel 11 via a spacer element 18 and, in the process, makes electrical contact with the reflector 7. Finally, the decoupling structural element could alternatively be arranged further away from the reflector surface 7 than the double-dipole arrangement 3, but this would then result in influences on the polar diagram for a decoupling level of intrinsically the same amount, if the distance between the decoupling structural element 17 and the reflector surface is more than half as great as that of the dipoles in the double-dipole arrangement 3. The arrangement is preferably such that the conductive decoupling structural element 17, in the form of a rod 17*a*, is not more that ⅛ to ¼ of a wavelength away from the reflector plane.

In a practical embodiment, the arrangement may be such that the dipoles 3' are located, for example, at a distance from 0.1 to 0.5 wavelengths, preferably 0.2 to 0.3 wavelengths and in particular about 2.25 wavelengths, in front of the reflector surface, in which case the decoupling structural element 17 may be at a distance of 0.015 to 0.125 wavelengths, in particular 0.015 to 0.035 wavelengths (that is to say about 1/60 to ⅛, and in particular 1/60 to 1/30 of the wavelength) away from the reflector surface 7.

Finally, in contrast to the illustrated exemplary embodiment, the decoupling structural element 17 need not be in the form of a rod, but may be in the form of a slot which is incorporated in the reflector surface 7 in the same position as the rod shown in the plan view in FIG. 1*a*. Another possible arrangement is a conductive surface at a distance in front of the reflector surface, in which a corresponding cutout is then introduced, which has a structure with a longitudinal extent, preferably parallel to and in the region of the connection or attachment direction 21.

The exemplary embodiment according to FIGS. 2*a*, 2*b* and 2*c* differs from the exemplary embodiment explained above in that the decoupling structural element 17 is not a rod 17*a* extending in the connection direction 21, a cruciform decoupling structural element 17*b*, comprising two mutually crossing rods, being used instead. In this case, FIG. 2*c* shows a schematic perspective [sic] illustration of the exemplary embodiment according to FIGS. 2*a* and 2*b*. In this exemplary embodiment, the rods 27 are virtually perpendicular to one another, the two rods each being aligned virtually parallel to the polarization planes, that is to say to the dipoles 3'. The cruciform decoupling structural element 17*b* with the rods 27 is likewise once again conductive, the two rods 27 being conductively connected to one another at their intersection 29.

The longitudinal component (in the connection or attachment direction 21) of the cruciform decoupling structural element 17 formed in this way is in this case, for example, 0.25 wavelengths to 1 wavelength, preferably 0.5 to 0.8 wavelengths and in particular about 0.7 wavelengths. The term "longitudinal component" in this case means the projection on the vertical, that is to say on the direct connecting line between two adjacent radiating element modules in the attachment direction. Owing to the symmetrical design, the extent in the direction at right angles to the attachment direction 21 is, of the same length, although this need not necessarily be the case.

In the case of the exemplary embodiment according to FIGS. 3*a* and 3*b*, so-called patch radiating elements 1*a* are used as radiating element modules in contrast to the exemplary embodiment according to FIGS. 2*a* and 2*b*, as are in principle known from the prior publication ITG Specialist Report 128 "Antennen" [Antennas], VDE-Verlag GmbH, Berlin, Offenbach, page 259. These are so-called aperture-coupled microstrip-patch antennas with a cruciform slot or offset slot arrangement for receiving two orthogonal, linear polarizations.

In plan view, the patch radiating elements 1*a* have a square structure and are aligned with their slot arrangement, in each case once again at an angle of 45° to the vertical V, so that they can receive or transmit both +45° and −45° polarizations.

Since, owing to the square structure of this individual feed system 1, the effective distance between the outer contours between the two radiating element modules 1 in the attachment direction 21 is designed to be comparatively short, the cruciform decoupling structural element 17, as has been described on the basis of the exemplary embodiment according to FIGS. 2*a* and 2*b*, is particularly suitable.

The exemplary embodiment according to FIGS. 4*a* and 4*b* differs from that according to FIGS. 3*a* and 3*b* only in that a corresponding cruciform slot 17*c* is now used as a decoupling structural element instead of the cruciform decoupling structural element 17*b* which is formed in the form of [sic] mutually crossing rods 27 and is arranged in front of the plane of the reflector 7, the arrangement and alignment of which cruciform slot 17*c* may otherwise correspond to the cruciform rod arrangement 17*b* according to FIGS. 3*a* and 3*b*. The dimensions may in this case be similar to those in the case of the cruciform rod arrangement according to FIGS. 3*a* and 3*b*.

Referring to FIG. 5, there is illustrated a reflector 20 having two patch radiating elements 22 supported in front of the reflector. Between the element 22, there is provided a decoupling element 24 comprised of a metal sheet conductive surface spaced in front of reflector 20 and having a slot 26 formed in its surface.

In the drawings, the mechanical anchorage and support of the dipoles 3 on the reflector or panel has been indicated only in FIGS. 1*a* to 2*c*. The normal structures are used for this purpose in order to anchor the individual dipoles on a substrate or on a panel, for example, via the said balancing devices 14, and to feed them electrically via this means. If, for example, the dipoles are anchored on the reflector plate, and are held above it, via two webs or arms and are conductively connected to the reflector plate, then the dipoles are fed from the panel via separate leads. In this context, reference is made, inter alia, only by way of example to DE 43 02 905 C2 or other dipole devices previously known therefrom. The other figures, 3*a* et seq., do not show the mechanical support of the dipoles with respect to the reflector or the panel in greater detail.

We claim:

1. An antenna array for simultaneous reception and/or simultaneous transmission of electromagnetic waves having two linear orthogonal polarizations, comprising:

a plurality of radiating element modules including at least two radiating element modules adjacent one another along a straight line defining a connection direction therebetween;

the radiating element modules each having a radiating element arrangement for simultaneous reception and/or transmission of electromagnetic waves having two orthogonal polarizations defining two mutually orthogonal polarization planes;

said connection direction of the antenna array being offset with respect to the alignment of the two mutually orthogonal polarization planes of the two orthogonal polarizations to be received and/or transmitted;

a decoupling device between said two adjacent radiating element modules;

said decoupling device including a decoupling element having a longitudinal component parallel to said connection direction of said two adjacent radiating element modules; and said longitudinal component of said decoupling element having a length equal to or greater than 25% of a separation distance between centers of said adjacent radiating element modules.

2. An antenna array according to claim 1 wherein the longitudinal extent of the longitudinal component of the decoupling element in said connection direction is at least 50% of said separation distance.

3. An antenna array according to claim 1 wherein the ratio of the length of the longitudinal component of the decoupling element in said connection direction to a length in a direction of a transverse component thereof is equal to or greater than 0.5.

4. An antenna array according to claim 1 wherein said decoupling element includes at least one electrically conductive rod extending substantially in said connection direction.

5. An antenna array according to claim 1 wherein said decoupling element comprises at least one slot having a longitudinal component extending in said connection direction.

6. An antenna array according to claim 5 including a reflector, said at least one slot being formed in said reflector.

7. An antenna array according to claim 5 including a reflector and a separate conductive surface disposed at a distance in front of said reflector, said at least one slot being formed in said separate conductive surface.

8. An antenna array according to claim 1 wherein said decoupling element has a cruciform shape.

9. An antenna array according to claim 8 wherein said decoupling element comprises two rods or a multiple thereof extending approximately at right angles to one another, said rods being conductive and aligned with respective longitudinal axes thereof parallel to the two polarizations.

10. An antenna array according to claim 9 including a reflector defining a plane, said rods extending substantially parallel to the reflector plane and conductively connected to one another at an intersection thereof.

11. An antenna array according to claim 8 including a reflector, said decoupling element including a cruciform slot in said reflector.

12. An antenna array according to claim 8 including a reflector and a conductive surface in front of said reflector, said decoupling element including a cruciform slot in said conductive surface.

13. An antenna array according to claim 8 wherein said cruciform-shaped decoupling element has two mutually perpendicular components aligned parallel to the two mutually orthogonal polarization planes of the two orthogonal polarizations to be received or transmitted.

14. An antenna array according to claim 1 including a reflector defining a plane, each of said radiating element modules lying along a straight line defining a connection direction between adjacent element modules, said decoupling device including decoupling elements each having a longitudinal component parallel to a connection direction between said adjacent radiating modules, said decoupling elements being arranged on different separation planes relative to said reflector plane, the distance from the reflector plane being less than or equal to half a wavelength of the electromagnetic waves to be received or transmitted.

15. An antenna array according to claim 1 wherein said decoupling element is formed symmetrically with respect to said straight line between said two adjacent radiating element modules and symmetrically with respect to said connection direction.

16. An antenna array according to claim 1 wherein said decoupling element is formed symmetrically with respect to a center transverse plane at right angles to said straight line between said two adjacent radiating element modules.

17. An antenna array according to claim 1 wherein said decoupling element is aligned symmetrically with respect to two mutually perpendicular planes parallel to the two polarization planes and which polarization planes are aligned orthogonally relative to one another for the reception of electromagnetic waves.

18. An antenna array according to claim 1 wherein the radiating element modules comprise dipole radiating elements.

19. An antenna array according to claim 1 wherein the radiating module elements comprise patch radiating elements.

* * * * *